United States Patent [19]

Brehm

[11] Patent Number: 4,553,382

[45] Date of Patent: Nov. 19, 1985

[54] DEVICE FOR PRODUCING TWIST-CRIMPED THREADS

[75] Inventor: Gustav Brehm, Wettswil, Switzerland

[73] Assignee: Retech AG, Boniswil, Switzerland

[21] Appl. No.: 532,986

[22] Filed: Sep. 16, 1983

[30] Foreign Application Priority Data

Sep. 29, 1982 [CH] Switzerland ..... 5727/82

[51] Int. Cl.[4] ..... D02G 1/02; D02G 1/04

[52] U.S. Cl. ..... 57/284; 57/285

[58] Field of Search ..... 57/284, 285, 282, 352

[56] References Cited

U.S. PATENT DOCUMENTS

| | | | |
|---|---|---|---|
| 3,192,697 | 7/1965 | Carruthers | 57/285 |
| 3,261,156 | 7/1966 | Kunzle et al. | 57/285 |
| 3,327,462 | 6/1967 | Wyatt | 57/285 |
| 3,395,524 | 8/1968 | Balassa | 57/285 |
| 3,553,952 | 1/1971 | McIntosh | 57/285 X |
| 3,613,403 | 10/1971 | Peel | 57/285 X |

*Primary Examiner*—Donald Watkins

*Attorney, Agent, or Firm*—Wegner & Bretschneider

[57] ABSTRACT

The separating head of the device contains a frame (10) in which a feed bush (12) for the twisting column (11) has been inserted at the top. Underneath this bush (12) there are the first arms (28) of double-armed levers (20, 21), which levers are components of a regulating facility which also includes a damping facility (30, 31) which acts on the second arms (29) of the levers (20, 21). The threads (16, 17) kept apart by the said first arms (28) loop around conical rollers (34, 35) of an equalizing roller (32), and then pass through a hollow shaft (2) out of the separating head (1). The other end of this shaft (2), on top of which the separating head sits tight, can be driven by means of a motor (7) via toothed wheels (5, 6).

18 Claims, 7 Drawing Figures

Figure 1:
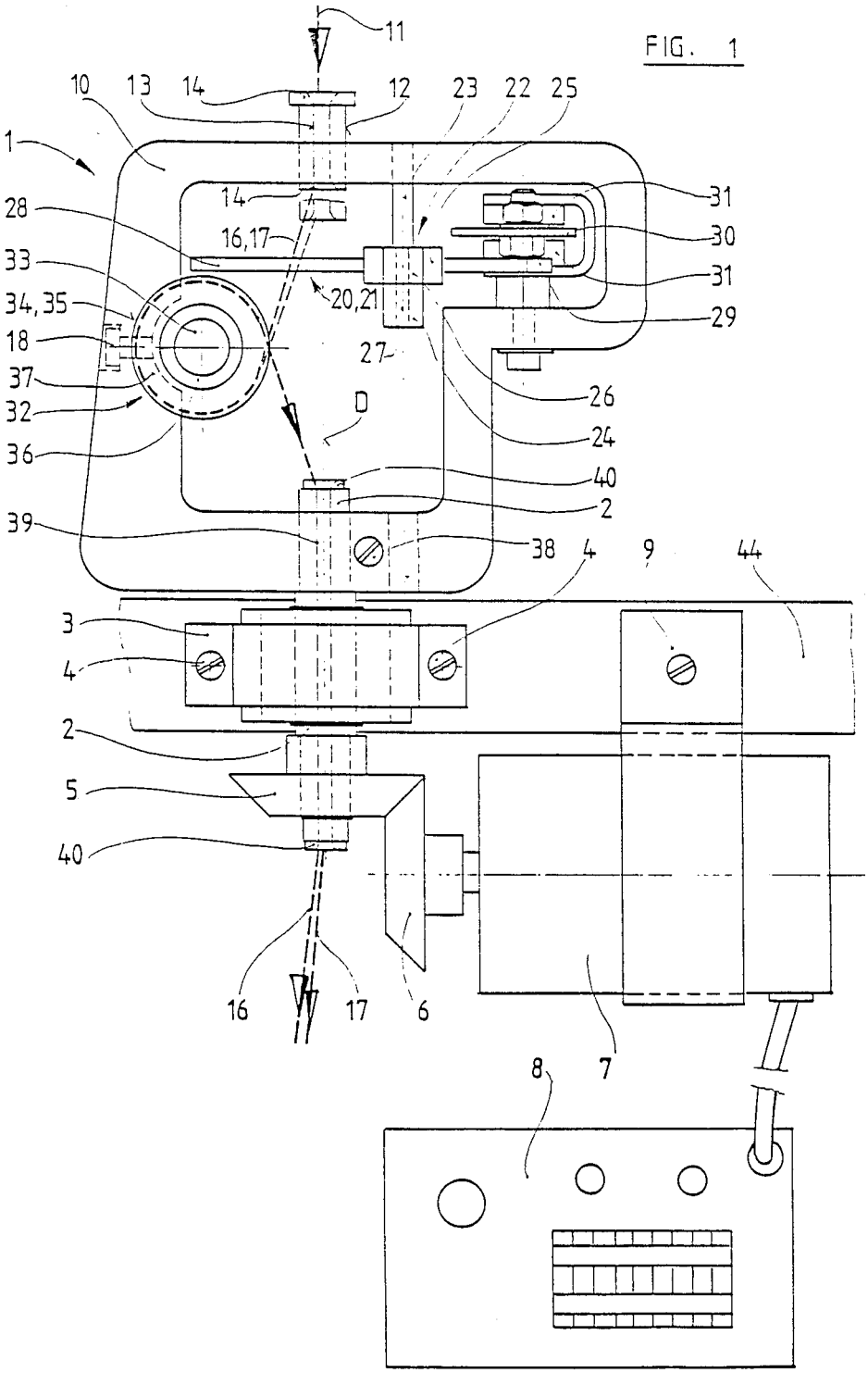

11
10
13
14
12
23
22
25
1
28
14
16,17
33
34,35
18
37
32
36
20,21
27
D
31
30
31
29
26
24
40
2
39
38
4
9
44
3
4
2
5
40
16
17
6
8
7

DEVICE FOR PRODUCING TWIST-CRIMPED THREADS

The present invention relates to a device for producing twist-crimped threads by means of a facility for heating and a facility for subsequently cooling down the threads, which form a twisting column, and by means of a head in which the crimped threads are separated from each other and which has a facility for regulating the separating process.

A device of this type is already known. In this device, the point where the threads of the crimped yarn are separated from each other is—viewed horizontally—between two fixed thread guides, and above them. One of the threads is deflected to one side underneath one of the fixed thread guides, and the other thread is deflected to the other side underneath the other fixed guide. The threads thus deflected arrive at guide rollers mounted at the ends of the levers of a parallelogram. These levers lie in a plane which is virtually parallel to that plane in which the twisting column lies. The other ends of the said levers have been coupled to the frame of the machine.

The threads pass from the guide rollers to an undriven equalizing roller. This roller has been mounted at a right-angle to the running direction of the threads, and it has conical end sections. These sections of the equalizing roller have been arranged symmetrically on either side of the separating point of the twisting column. The diameter of these conical sections increases outward, in opposite directions. The threads loop around the respective section of the roller under a circumferential angle of slightly more than 180°, and they then pass to deflection rollers mounted at the end of a shaft. This shaft has been coupled to the levers of the parallelogram. This shaft consequently ensures that, whatever the position of the levers, there is a certain distance between the guide roller ends of the levers of the parallelogram. From the deflection rollers, the threads pass to the take-off rollers and then, finally, to the take-up rollers for the threads.

The guide rollers transmit the pulling force in the individual threads deflected sideways at the thread guides to the ends of the levers in the opposite direction. As long as the pulling forces in the two threads are the same, the forces acting on the lever ends cancel each other out. The guide rollers are in a symmetrical position either side of the fixed thread guides. Correspondingly, the two thread speeds are also the same. If the pulling force increases in one of the two threads, the levers pivot towards the thread with the smaller pulling force. As a result the thread with the higher pulling force moves into such a zone of the conical section of the equalizing roller as has a smaller diameter, while the opposite holds for the other thread. Without changing the rotational speed of the equalizing rollers, the two yarn speeds thus change in opposite directions until the equilibrium of forces is reestablished at the levers.

The speeds of the threads in the separating heads are very considerable in devices of this type. The guide rollers and the deflection rollers consequently revolve with an appreciable speed at which their mass is no longer negligible. When the levers of the parallelogram move rapidly, the guide rollers as well as the deflection rollers need to be decelerated rapidly or accelerated rapidly. Because of the mass of the rollers which is not negligible, the decelerating or accelerating thereof takes place with a certain delay. As a result, the threads slip on the conical sections of the equalizing roller, despite the adhesive coating on its surface, and the consequence is that the regulating process described is disrupted. With the looping angle being so small, the frictional differences between the two sections of the roller, which are unavoidable as a consequence of differences in radial play and grease levels, also have an adverse effect. The fact that the rollers are mounted on the levers gives rise, in the threads, to pulley forces which interfere with the regulating process, especially with its sensitivity.

It is the object of the present invention to specify a device for producing twist-crimped threads which are not only free of the disadvantages mentioned but which also have further advantages.

This object is achieved in a novel manner for the device of the type mentioned in the introduction as is defined in the characterizing part of claim 1.

Figure 2:
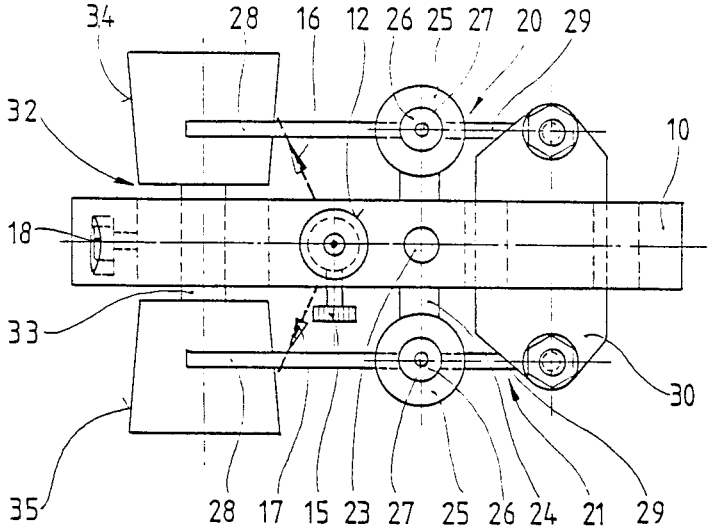
Figure 7:
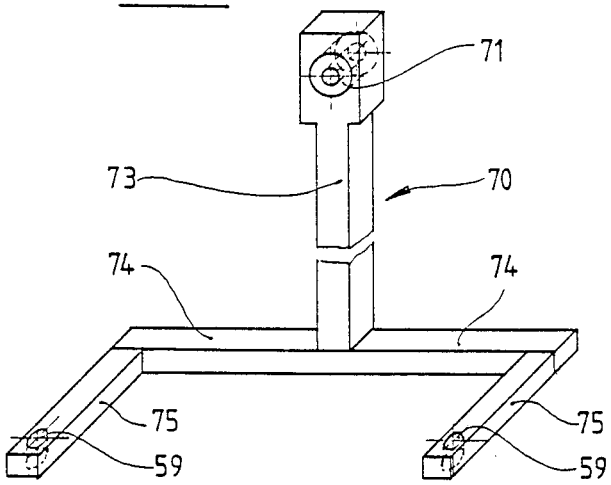
Figure 4:
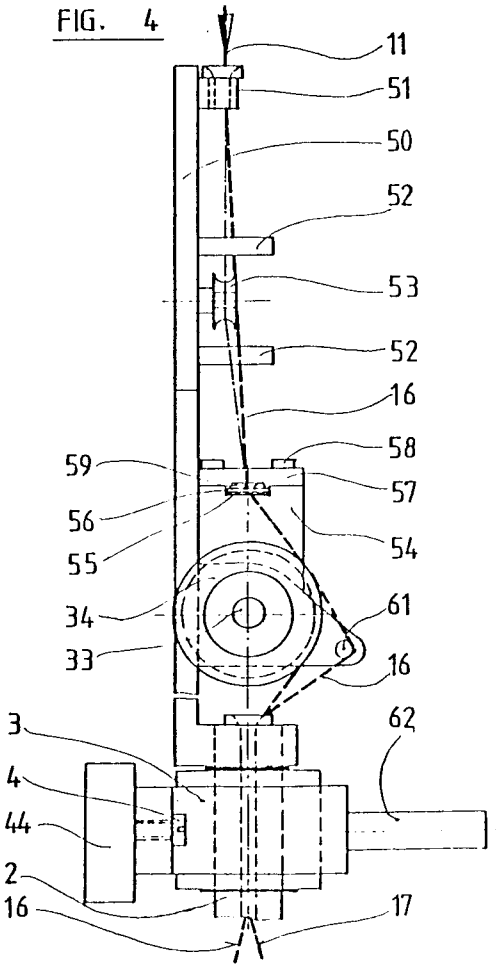
Figure 3:
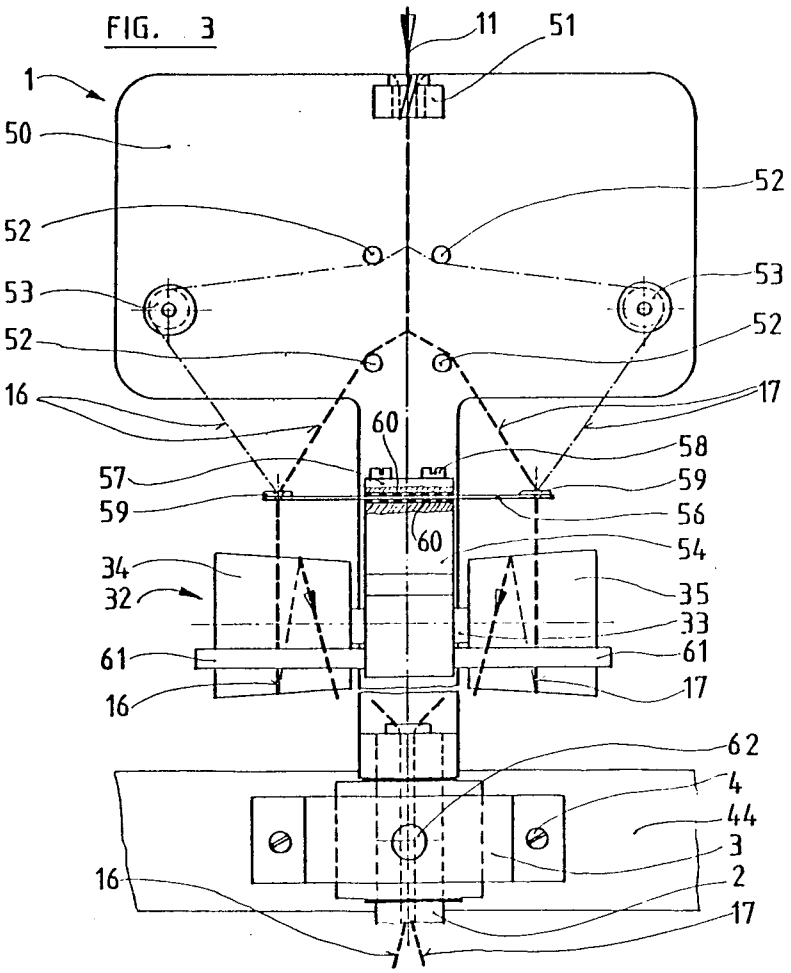
Figure 6:
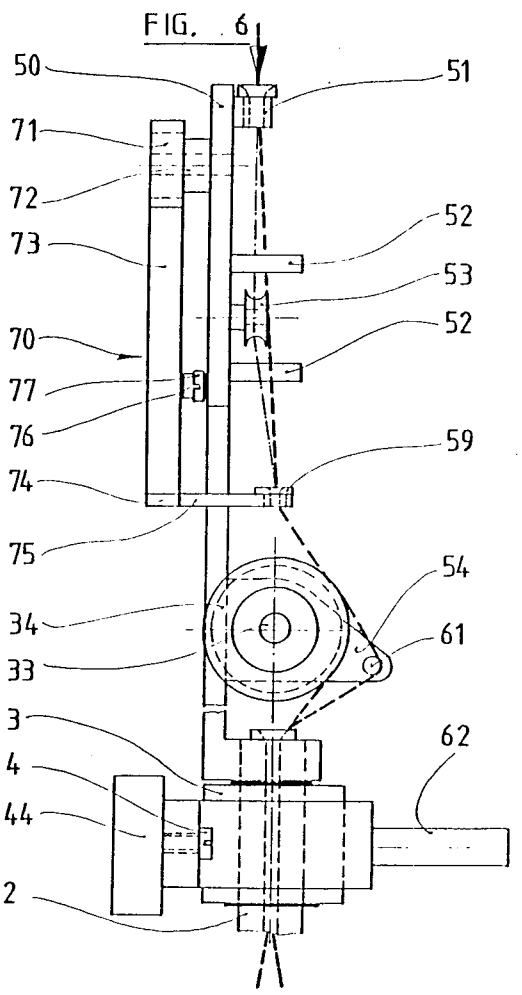
Figure 5:
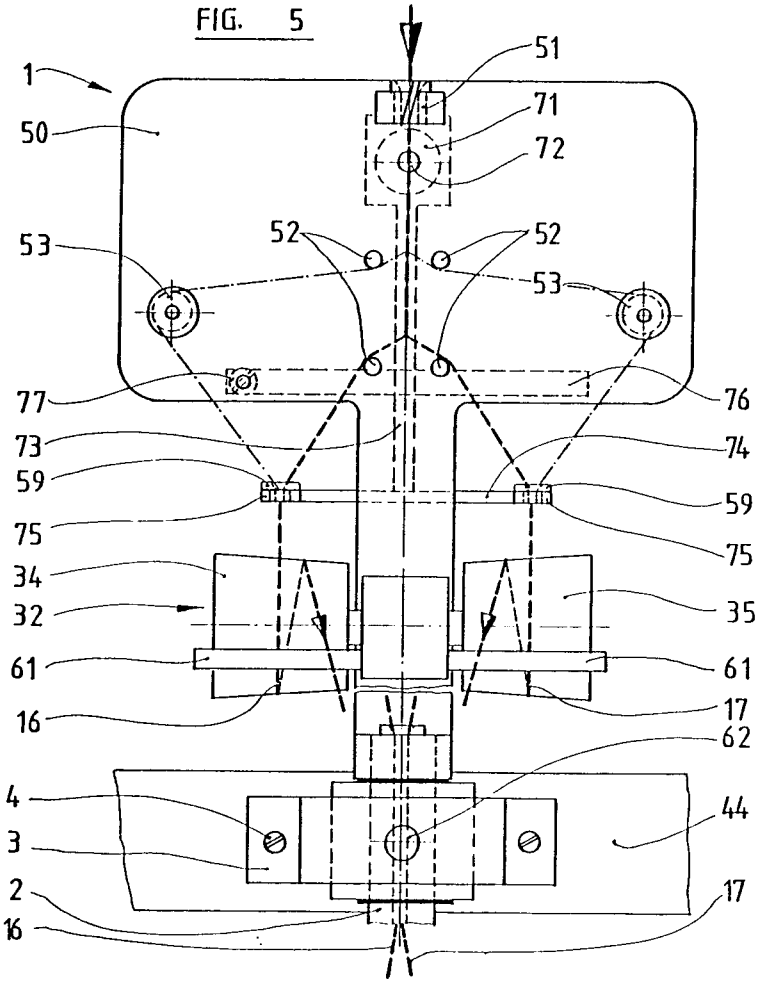

Below, embodiments of the present invention are illustrated in more detail by means of the accompanying drawings, in which:

FIG. 1 shows a side view of the separating head of the present device, including the drive for the same, FIG. 2 shows a top view of the arrangement in FIG. 1, FIG. 3 shows—partly in section—the front view of a second embodiment of the separating head of the present device, FIG. 4 shows a side view of the separating head in FIG. 3, FIG. 5 shows a front view of a third embodiment of the said separating head, FIG. 6 shows a side view of the separating head in FIG. 5, and FIG. 7 shows a perspective view of the pendulum of the separating head in FIGS. 5 and 6.

The device for twist-crimping threads has a facility which is known per se for heating the threads to be crimped and a facility for cooling down the threads, which can also be referred to as a facility for setting the crimp. Since these facilities are generally known in devices of the type mentioned, it is not necessary to depict them or to explain them herein in more detail.

The facility for setting the crimp is followed by a separating head 1 (FIG. 1) which sits on a shaft 2. The crimped threads forming the twisting column are separated from each other inside the separating head 1. The said shaft 2 is hollow and has been rotatably mounted by means of a bearing inside a housing 3. The bearing housing 3 has been secured to the frame 44 of the entire device by means of bolts 4. The lower end of the hollow shaft 2 has been provided with a bevel wheel 5 which meshes with a second beveled wheel 6. This second bevel wheel 6 has been secured to the shaft of an electric motor 7 by means of which the number of revolutions of its rotor can be predetermined by means of a facility 8 which is known per se and has therefore only been hinted at. The motor 7 has been removably attached to the frame 44 of the device by means of a bracket 9.

The separating head 1 has a frame 10 to which all the other components have been attached. In the upper part of the separating head 1 depicted in FIG. 1 there is a means for feeding the crimped threads 16, 17 forming the twisting column 11 into the separating head 1. This means takes the form of a bush 12 which goes through the upper part of the frame 10. This bush 12 has been lined with a ceramic material 13 which wears only slightly as a result of the yarn 11 running through. This bush 12 has, at the upper end and at the lower end, collar eyelets 14 which allow the yarn 11 to enter and leave at an angle. The bush 12 has been mounted in such a way in the frame 10 as to be shiftable in the longitudinal direction, so that the distance between the outlet opening of the bush 12 and the other components of the separating head 1 can be adjusted. A bolt 15 (FIG. 2) makes it possible to arrest the bush 12 in whichever position has been set. However, the position of the bush 12 can also be adjusted by virtue of the fact that its outer surface has been provided with a thread, so that the bush 12 can be screwed into the frame 10.

The position of the end of the yarn column 11, ie. that point where the threads forming the yarn column separate from each other, depends on several factors in the course of operating the device. Some of these factors can hardly be controlled. As a consequence, the position of the said separating point changes more or less in the course of operating the device. It may happen that the separating point even begins to oscillate, and in that case the threads separate from each other in a completely uncontrolled fashion. This fact hampers the operation of the device. However, it has been found that the process of separating the threads can be controlled by suitably adjusting the distance between the bush 12 and the other components of the separating head.

Viewed in the running direction of the threads, the bush 12 is followed by a facility for regulating the separation of the threads 16 and 17 forming the yarn column 11. This facility includes first of all a parallelogram which contains double-armed levers 20 and 21. These levers 20 and 21 lie in a plane which runs vertically to the twisting column 11, and the levers 20 and 21 can also be moved in this plane. The middle part of these levers 20 and 21 has been mounted on a support 22 which has been suspended from the upper horizontal section of the frame 10. The support 22 contains a supporting rod 23 whose upper end has been inserted into the upper part of the frame 10. The lower end of the supporting rod 23 carries a transverse support 24 on which the middle part of whichever lever 20 and 21 has been mounted. For this purpose, the respective lever 20 or 21 has a ring-shaped holder 25 in which there is a bearing 26. This bearing 26 sits on a pin 27 which has been inserted in the transverse support 24. The pins 27 lie outside the axis of the hollow shaft 2, on the center of gravity side of the parallelogram.

Two rods 28 and 29 have been inserted from opposite sides into the ring-shaped holder 25 to constitute the arms of the double-armed levers 20 and 21. These levers are advantageously equal-armed levers. Those arms 28 of levers 20 and 21 which are underneath the bush 12 have been made of a ceramic material. It is consequently possible for the threads 16 and 17, after the yarn 11 has left the bush 12, to glide directly on the surface of the rods 28 without causing noticeable wear on these rods 28.

The end parts of the two arms 29 of the levers 20 and 21 have been connected to each other by means of a coupling member 30. The coupling member 30 has been designed as a plate which has been coupled to the lever arms 29. This plate 30 ensures that the levers 20 and 21 are always parallel to each other, whatever their pivoting position. The said plate 30 has been assigned a magnet 31 which consists of two parts. The two parts of the magnet 31 have been attached to the frame 10 of the separating head 1, one part of the magnet 31 being above the plate 30 and the other part of the magnet 31 being below the plate 30. The plate 30 has been made of a metal, so that eddy currents are induced in this plate when the plate 30 moves between the parts of the magnet 31. The coupling member 30 thus also acts as a braking plate when the levers 20 and 21 change position as a result of the forces acting in the threads 16 and 17. This brake or damping facility prevents the levers 20 and 21 of the regulating facility from oscillating in the course of the operation of the separating head 1.

The first arms 28 of the levers 20 and 21 are followed by an undriven equalizing roller 32. It has a shaft arranged at a right-angle to the direction of the twisting column 11 and fixed in the frame 10 of the separating head 1 by means of a bolt 18. Conical rollers 34 and 35 have been mounted on the end parts of the shaft 33. A metal core 36 is covered with a coating 37 of a material which has a high coefficient of friction. This coating 37 can consist, for example, of rubber, ceramic material, or nickel-dipped cores of a hard material having a diameter of 2 to 10 micrometers. The surface of the coating 37 has been shaped in such a way that the coating 37 has the conical shape mentioned, in which the diameter of the coatings 37 and hence of the entire rollers 34 and 35 increases outwards.

The equalizing roller 32 is followed by a facility for guiding the threads 16 and 17 out of the separating head 1. This facility contains the hollow shaft 2 which has already been mentioned and on which the separating head 1 has been clamped tight by means of a bolt 38. On the inside this shaft 2 has been lined with a ceramic material 39 which turns into collar eyelets 40 at the start and at the end of shaft 2. This hollow shaft 2 and the bush 12 have been arranged on the same axis, and they have been mounted in such a way in the frame 10 of the separating head 1 that their axes coincide with the turning axis D of the separating head 1. The feed system and the take-up bobbins for the crimped threads, which follow behind the separating head 1, have not been depicted, being generally known for such devices.

The frame 10 of the separating head 1 has been constructed as a sturdy one-piece frame, and the other components of the separating head have been constructed and attached to this frame 10 in such a way that the separating head has a bulge relative to its turning axis D. This bulged design of the separating head is also due, in part, to, for example, the fact that the regulating facility mentioned has been constructed as already described.

Before the beginning of the crimping process the threads 16 and 17 are guided through the facilities for heating up and cooling down these threads and through the bush 12. Thereafter one of the threads 16 is guided over the first arm 28 of one of the levers 20 or 21. The other thread 17 is guided over the first arm 28 of the other of the said levers. The separating point of the threads 16 and 17 is thus between the exit opening of the bush 12 and the two levers 20 and 21. Each of the threads 16 and 17 is then looped around one of the conical rollers 34 or 35, and the two threads are guided through the hollow shaft 2 and through the feed system. However, they are not yet connected to the take-up bobbins. Now the conveying of the threads 16 and 17 through the device can begin, after which the threads attain the full operating speed.

At the start of operation, the twist density of the column 11, which consists of the threads 16 and 17, is either equal to zero or very low. The desired twist density for column 11 is set at the control facility 8 for the motor 7, and the motor 7 can be set in operation. Thereafter, the motor 7 drives the hollow shaft 2 and, consequently, also the separating head 1. When the separating head 1 has formed the number of turns to correspond to the desired twist density of the twisting column 11, the motor 7 is switched off, and the separating head 1 is then at a standstill. The threads 16 and 17, however, continue to run through the separating head with undiminished speed. At this time, the threads have already been crimped. One of the two threads is guided by means of a suction gun from the feed system to one of the bobbins, and the other thread is guided to the other take-up bobbin. From now on the threads 16 and 17 are wound up on the said bobbins. The motor 7 can then be removed from this separating head 1, and they can be used to adjust, in the manner described, the twist density in a further twisting column.

During the operation of the device the crimped threads 16 and 17 which are in the lower zone of the yarn column 11 pass through the bush 12 into the stationary separating head 1, where they are separated from each other. The threads 16 and 17 then go on to pass over the first arm 28 of the respective lever 20 or 21 to one of the rollers 34 or 35 of the equalizing roller 32. The two threads 16 and 17 then leave the separating head 1 through the hollow shaft 2. If unequal pulling forces arise in the threads 16 and 17, the regulating process which has already been described in the introduction takes place and balances the pulling forces in the threads 16 and 17.

Since the bush 12 is in the upper part of the frame 10, while the shaft 2 passes through the frame 10 at the bottom, the wrapping angle by the threads 16 and 17 on the rollers 34 and 35 is almost 360°. Since the wrapping angle is known to make an exponential contribution to the thread-tractive force, such an arrangement increases the thread-tractive reliability quite considerably, compared with the state of the art device discussed at the outset. Experiments have shown that the threads 16 and 17 do not become entangled in the device of the invention, although the wrapping angle on the rollers 34 and 35 is nearly 360°.

As has already been said, the threads 16 and 17 glide on only a short section of the surface of the rod-shaped first arms 28 of the regulating levers 20 and 21. The said threads merely wrap around the rollers 34 and 35 of the equalizing roller 32. The pulling forces active in the said threads are thus available in virtually undiminished form for controlling the equalizing of the pulling forces in the threads, and that without any delay or the like. Consequently the regulating process proceeds very sensitively and such a device works very reliably. Nor do the levers 20 and 21 vibrate, because such vibrations are dampened by the plate 30 and the magnet 31. As a result, the quality of the crimped threads is ensured over time and also over positions on a machine. This constitutes a prerequisite for obtaining higher production speeds for crimped threads.

FIGS. 3 and 4 depict a further embodiment of the separating head 1 of the present device. This separating head 1 contains a base plate 50 which has been provided at the top with an angled-slot eyelet 51 for feeding the yarn column 11 into the separating head 1. Underneath this eyelet 51, pins 52 have been inserted in the base plate 50. On either side of the eyelet 51 there are a number of such pins 52 which have advantageously been made of a ceramic material. In the embodiment illustrated, the side parts of the base plate 50 have been provided with auxiliary rollers 53, the purpose of which will be dealt with later on.

Underneath the pins 52 there is a mounting block 54 for the equalizing roller 32 which has already been discussed. In its upper part this mounting block 54 has been provided with a groove 55 in which a lever 56 has been fitted in a manner permitting longitudinal sliding. This lever 56 lies in a plane which is at a right-angle to the twisting column 11, and the longitudinal axis of the lever 56 is virtually parallel to the axis of the equalizing roller 32. The lever 56 can slide in the axial direction of the equalizing roller 32. Advantageously, the lever 56 is directly above the shaft 33 of the equalizing roller 32. However, the lever 56 can also be in front of or behind the roller shaft 33, whereby, for example, the wrapping angle of the threads 16 and 17 on the roller 32 can be changed.

A plate 57 has been attached in such a way to the mounting block 54 by means of bolts 58 that this plate 57 holds the lever 56 in the groove 55. The end parts of the lever 56 have been provided with collar eyelets 59 through which the crimped threads 16 and 17 can pass.

The middle part of the lever 56 has been surrounded by a layer 60 of damping oil, for example silicone oil. Such a damping facility prevents the lever 56 from oscillating under the influence of rapidly changing forces in the threads 16 and 17. The lever 56 can thus only execute those movements which are caused by relatively prolonged thread-pulling forces.

The mounting block 54 has been provided with a rod 61 which is virtually parallel to the axis of the equalizing roller 32. This rod 61 allows the wrapping angle on the equalizing roller 32 to be made smaller. The size of the said wrapping angle can be adjusted by arranging for the rod 61 to be as high as required on or in the mounting block 54.

The lower part of the base plate 50 has been fixed to the shaft 2 which, as in the case of the separating head of FIG. 1, has been attached to the frame 44 of the device by means of the bearing housing 3 and the bolts 4. Although this situation has not been depicted in FIGS. 3 and 4, in this case too the shaft 2 can be driven by means of the motor 7. As can be seen from FIG. 4, the front part of the bearing housing 3 in this embodiment of the separating head 1 has been provided with a mandrel 62. The housing of the motor 7 has been provided with a corresponding bore (not depicted) which is in the axial direction of the motor 7 and in which the mandrel 62 can come to rest. In such a case, the motor 7 need not be attached to the frame 44 of the device by means of the bracket 9. The motor 7 need only be slipped over the mandrel 62 from the front until the bevel wheel 6 of the motor meshes with the bevel wheel 5 of the shaft 2. Once the required twist density has been reached in the twisting column 11, the motor 7 need simply be pulled away from the mandrel 62, and it can be simply reengaged on the mandrel of an adjacent separating head to achieve the required twist density also for the yarn column assigned to this separating head. The said mandrel 62 thus serves as a facility for temporarily attaching the motor 7 to the separating head 1.

As can be seen from FIG. 3, the yarn column 11 passes through the angled-slot eyelet 51, and behind this eyelet 51 the yarn column is redivided into the individual threads 16 and 17. Depending on the circumstances prevailing when the threads are separated from each other, one of the pairs of pins 52 can be chosen for separating the threads 16 and 17. In the case depicted, the lowermost pair of ceramic pins 52 has been used for this purpose. From the pins 53 the threads 16 and 17 pass to the lever 56. They pass through the eyelets 59 in the end parts of this lever 56 and arrive at the equalizing roller 32 around which the threads 16 and 17 loop. The threads 16 and 17 then leave the separating head 1 through the shaft 2.

As can be seen from FIG. 4 in particular, the wrapping angle of the threads 16 and 17 on the equalizing roller 32 is even greater than 360°. The mutual action between the thread and the respective conical roller 34 or 35 of the equalizing roller 32 is thus fairly intense, and provides favorable conditions for a fairly sensitive control of the separating process of the threads 16 and 17. If there is a danger of the threads becoming jammed, the wrapping angle can be reduced by means of the rod 61, namely by guiding the threads 16 and 17 from the equalizing roller 32 not directly to the shaft 2 but first to the rod 61, as is indicated in FIG. 4 in the form of the thread section 161. In the case depicted, the rod 61 is low down in the mounting block 54, so that the wrapping angle is only slightly reduced by the measure just explained. However, the higher the rod 61 is arranged relative to the axis of the equalizing roller 32, the smaller is the wrapping angle.

The depicted conical rollers 34 and 35 have a diameter which increases to the outside. However, it is also, simply, possible to construct these rollers 34 and 35 in such a way that their diameter decreases toward the outside. This embodiment of the said rollers can be particularly advantageous, for example, when winding the threads around the rollers at the start of the crimping process. In such a case, the threads 16 and 17 can be guided under the upper pair of pins 52 to the rollers 53 already mentioned at the edge parts of the base plate 50. From there the threads 16 and 17, as shown by the dash-dot lines in FIG. 3, pass to the eyelets 59 in the lever 56. The length of the lever 56 is less than the distance between the two auxiliary rollers 53.

FIGS. 5 and 6 depict yet another embodiment of the separating head 1, which resembles the separating head depicted in FIGS. 3 and 4. For this reason those reference numerals of FIGS. 3 and 4 which also apply to the separating head in FIGS. 5 and 6 have been re-used. This third embodiment of the separating head 1 differs from the preceding embodiment, especially in the mounting and the design of the levers. At the rear side of the base plate 50 a pendulum 70, which has a mounting socket 71, has been mounted on a shaft 72 which has been slotted into the base plate 50. A two-armed lever 74 has been attached to the lower end of the pendulum arm 73. Figure 7 is a perspective view of the pendulum 70 plus the lever 74.

The lever 74 is a two-armed lever whose middle part has been fixed to the end of the lever 70. The end sections of the two-armed lever 74 have been provided with angled-off parts 75. These parts 75 are long enough to reach from the pendulum 70 to the equalizing roller 32 on the front face of the base plate 50. Eyelets 59 through which the threads can pass as described in the context of FIGS. 3 and 4 have been countersunk in that zone of the angled-off parts 75 of the lever 74 which is above the roller 32.

The damping facility used in the present case is strip-shaped spring 76 which has been fastened to the rear face of the base plate 50 by means of a bolt 77. This spring 76 has been bent in such a way that the arm 73 of the pendulum 70 drags thereon. The pendulum 70 and thus also the lever 74 are braked by this spring 76, and as a result the lever 74 is prevented from oscillating in the course of the operation of the device.

The threads 16 and 17 in this embodiment of the separating head are guided virtually the same way as in the case of the separating head in FIGS. 3 and 4. According to how large the difference is between the pulling forces in the threads, the pendulum 70 plus the lever 74 swings out, and this is then followed by the regulating process already described herein and the equilibrium of forces on these threads is re-established.

Also this embodiment of the separating head can have conical rollers 34 and 35 whose diameter decreases toward the outside. For this case, this separating head 1 has likewise been provided with the auxiliary rollers 53. The length of the lever 74 is less than the distance between the auxiliary rollers 53.

However, the pendulum can also have been constructed in another way. It can have been made of a flexible material, such as, for example, carbon laminate fibers. One end of such a pendulum has been clamped (not depicted) into the base plate 50, and the other end of the pendulum has been provided with the lever 74.

Such arrangements enable the twisting column to be built up gently and more rapidly than hitherto. At this point reference should also be made to the possibility, already described, of using a single motor 7 to drive several separating heads 1 in succession. The start of the crimping process can take place more reliably than hitherto. As is evident from the above description, the buildup of the twisting column takes place in a very simple manner from the point of view of the person operating the machine.

On using the separating head described, it is easier to reach relatively high twisting densities in the twisting column 11, because the twist is applied to the threads only after the threads have attained the full operating speed. The regulating of the thread-pulling forces already discussed can thus already take place in the course of the build-up of the twisting column.

A particular advantage of this device concerns the possibility of altering the twisting density even in the course of the operation of the device, namely, as has already been indicated, by controlling the motor 7 in a suitable manner by means of the facility 8.

The separating heads described have a very simple design, compared with the existing separating heads, and they are space-saving and low in mass, but they can, nevertheless, be subjected to high dynamic stress.

I claim:

1. A thread separating head apparatus for producing separate twist-crimp threads from a twisting column where said threads are first heated, twisted in said twisting column, and subsequently cooled down, said head having a separation regulator comprising in combination:

a lever means which lies in a plane which is at a right angle to said twisting column for guiding said thread;

an undriven equalizing roller connected behind said lever when viewed in the running direction of said separate twist-crimped threads; and means for damping the motion of said lever means.

2. The thread separating head of claim 1 wherein said separation regulator further comprises:

a parallelogram which is followed by said undriven equalizing roller and which contains levers which lie in a plane which runs at a right angle to said twisting column, in which plane said levers can also be moved, and wherein the middle part of said levers is mounted on a support suspended from a frame.

3. The apparatus in accordance with claim 2 wherein said arms of said levers are beneath a bush which guides the yarns.

4. The apparatus of claim 3 wherein said bush is made of a ceramic material.

5. The apparatus in accordance with claim 4 wherein said arms are connected together by means of a coupling means.

6. The apparatus in accordance with claim 5 wherein said coupling member is a metal plate and wherein a magnet is assigned to said plate so that eddy currents can be induced in said plate.

7. The apparatus in accordance with claim 1 wherein said separating head further comprises:

a base plate which is located at the top end of said head which contains an angle-slot eyelet;

pins located underneath of said angle-slot eyelet and which are inserted in said base plate;

a mounting block for equalizing said undriven roller located beneath said pins;

wherein said mounting block is provided with a groove in which a lever is fitted in a manner permitting longitudinal sliding, said lever is at a right angle to said twisting column, the longitudinal axis of the lever is substantially parallel to the axis of said undriven equalizing roller, the end parts of the lever are provided with collar eyelets through which said separate twist-crimp threads pass, and said mounting block is provided with a damping means for said lever; and wherein the lower part of said base plate is fixed to the rotary shaft upon which said thread separating head is mounted.

8. A device as set forth in claim 7 wherein said damping means comprises a layer of damping oil surrounding the middle part of said lever.

9. The device as set forth in claim 8 wherein said oil is silicone oil.

10. A device as claimed in claim 7 further comprising a plate which is attached to said mounting block and said plate holds said lever in said groove.

11. The apparatus in accordance with claim 1 further comprising:

a base plate which is provided at the portion of said head which includes an angle-slot eyelet;

pins inserted in said base plate beneath said angle-slot eyelet;

a mounting block for said undriven equalizing rollers which is located on the rear side of said base plate;

wherein said mounting block is provided with a pendulum, a two-armed lever which is attached to the lower end of said pendulum arm, and which is provided with angled-off parts which are long enough to reach from said pendulum to said undriven equalizing roller, and which is at a right angle to said twisting column;

wherein the end zones of said angled-off parts of said lever are provided with collar eyelets through which the crimped threads pass; and wherein said base is provided with damping means for said lever, and the lower part of said base plate is fixed to a shaft upon which said head is mounted.

12. The apparatus in accordance with claim 11 further comprising a strip-shaped spring which is fastened to the rear face of said base plate, wherein said spring is bent in such a way that said arm of said pendulum drags thereon.

13. The apparatus as set forth in claim 11 wherein said mounting block is provided with a rod which is virtually parallel to the axis of said undriven equalizing roller whereby the position of said rod can be adjusted in a vertical direction.

14. The apparatus as set forth in claim 1 wherein said mounting block is provided with a rod which is virtually parallel to the axis of said undriven equalizing roller whereby the position of said rod can be adjusted in a vertical direction.

15. The apparatus in accordance with claim 1 further comprising:

a hollow shaft which is rotatably mounted on a frame, and wherein said separating head is fixed to one end of said shaft, and the other end of said shaft is provided with a toothed wheel;

a motor mounted on said frame and having a second toothed wheel which meshes with said first toothed wheel;

means predetermining the number of revolutions of the rotor of said motor; and takeup bobbins placed behind said separating head.

16. The apparatus in accordance with claim 15 wherein said mounted motor is mounted by means of a mandrel, and the housing of said motor is provided with a corresponding bore in the axial direction of said motor and in which bore said mandrel can come to rest.

17. The apparatus in accordance with claim 2 wherein said separating head further comprises:

a frame constructed as a sturdy one-piece frame to which all other components are attached;

a bush which passes through the upper part of said frame;

a shaft which passes through the lower part of said frame; and wherein said hollow shaft and said bush are arranged on the same axis so that their axes coincide with the turning axis of said separating head is constructed so that said separating head has a bulge relative to its turning axis.

18. The apparatus in accordance with claim 17 wherein said bush is lined with a ceramic material and bush collar eyelets are placed at the upper end and the lower end of said bush, and wherein said bush is shiftable and attachable in the longitudinal direction of said frame.

* * * * *